US010493587B2

(12) United States Patent
Viebahn et al.

(10) Patent No.: US 10,493,587 B2
(45) Date of Patent: Dec. 3, 2019

(54) PROCESSING SECTION FOR A FLOOR-PROCESSING MACHINE, ADAPTER SYSTEM FOR A FLOOR-PROCESSING MACHINE, FLOOR-PROCESSING MACHINE AND TOOL THEREFOR

(71) Applicant: Visaatec GmbH, Wiehl-Marienhagen (DE)

(72) Inventors: Marc Viebahn, Engelskirchen (DE); Anis Saad, Engelskirchen (DE)

(73) Assignee: Visaatec GmbH, Wiehl-Marienhagen (DE)

( * ) Notice: Subject to any disclaimer, the term of this patent is extended or adjusted under 35 U.S.C. 154(b) by 0 days.

(21) Appl. No.: 15/458,308

(22) Filed: Mar. 14, 2017

(65) Prior Publication Data

US 2017/0259391 A1 Sep. 14, 2017

(30) Foreign Application Priority Data

Mar. 14, 2016 (EP) ..... 16160218

(51) Int. Cl.

| | |
|---|---|
| ***B24B 7/18*** | (2006.01) |
| ***B24B 41/02*** | (2006.01) |
| ***B24B 45/00*** | (2006.01) |
| ***B24D 7/06*** | (2006.01) |

(52) U.S. Cl.

CPC ..... *B24B 7/186* (2013.01); *B24B 41/02* (2013.01); *B24B 45/003* (2013.01); *B24B 45/006* (2013.01); *B24D 7/066* (2013.01)

(58) Field of Classification Search

CPC ..... B24B 41/02; B24B 7/186; B24B 45/003; B24B 45/006; B24D 7/066

See application file for complete search history.

(56) References Cited

U.S. PATENT DOCUMENTS 5,054,245 A * 10/1991 Coty ..... A47L 11/164 15/98
6,959,473 B1 * 11/2005 Anibas ..... B25B 27/00 29/239
7,670,208 B2 * 3/2010 Thysell ..... B24B 7/186 125/3

(Continued)

FOREIGN PATENT DOCUMENTS

DE 20220969 U1 8/2004
WO WO 2017053737 A1 * 3/2017 ..... B24D 13/14

*Primary Examiner* — Marc Carlson

(74) *Attorney, Agent, or Firm* — Meunier Carlin & Curfman LLC

(57) ABSTRACT

The invention relates to a processing section 1 and an adapter system 10 of a floor-processing machine. The processing section 1 comprises a base body 2 with a processing side 3 and a mounting side, wherein the mounting side is arranged on the opposite side of the processing side 3 of the base body 2. The mounting side comprises at least one first mounting element for detachably fastening the processing section to the adapter system. The processing side 3 is formed as a closed processing surface 5. The adapter system 10 has a receiving side 11 which comprises at least one receptacle 12. The receptacle 12 comprises at least one second mounting element for detachably fastening the processing section 1 in the receptacle 12. Finally, the invention relates to a floor-processing machine and a tool.

10 Claims, 9 Drawing Sheets

(56) References Cited

U.S. PATENT DOCUMENTS

Figure 1A:
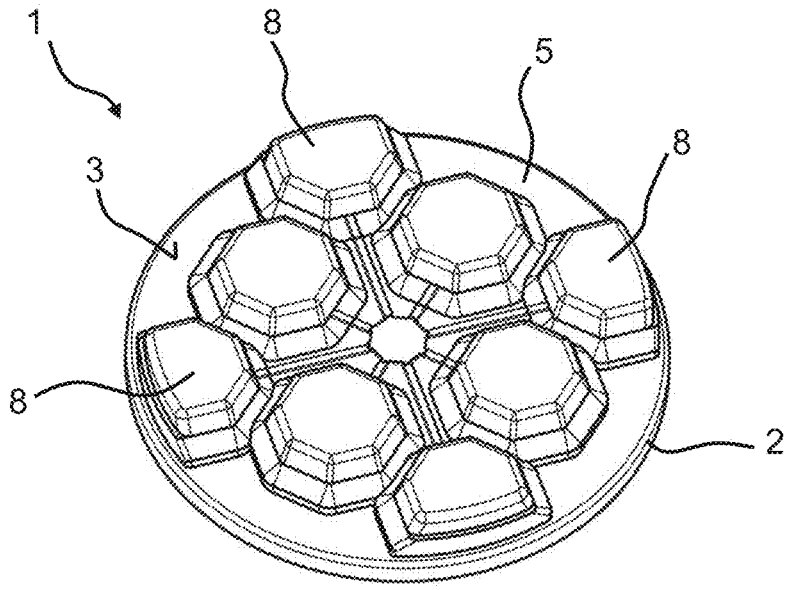

| | | | | |
|---|---|---|---|---|
| 7,713,109 | B2 * | 5/2010 | Estes | B24B 45/006 451/353 |
| D626,977 | S * | 11/2010 | Popov | D15/126 |
| D626,978 | S * | 11/2010 | Huh | D15/126 |
| 7,828,632 | B2 * | 11/2010 | Palushi | B24B 7/186 451/350 |
| 8,192,255 | B2 * | 6/2012 | Gallup | B24B 41/066 125/22 |
| 9,387,569 | B2 * | 7/2016 | Blick | B24B 41/002 |
| 9,925,645 | B2 * | 3/2018 | Song | B24D 7/066 |
| 9,931,734 | B2 * | 4/2018 | Fogelberg | B24D 7/18 |
| 2008/0305730 | A1 * | 12/2008 | Ilgner | B24B 7/186 451/548 |
| 2012/0270483 | A1 * | 10/2012 | Bae | B24B 7/186 451/540 |
| 2017/0129067 | A1 * | 5/2017 | Young | B24B 7/186 |
| 2017/0361414 | A1 * | 12/2017 | Tchakarov | B24B 41/047 |
| 2017/0361423 | A1 * | 12/2017 | Tchakarov | B24D 7/08 |
| 2018/0015588 | A1 * | 1/2018 | Rogers | B24B 7/186 |
| 2018/0085889 | A1 * | 3/2018 | Hutton | B24B 37/27 |

* cited by examiner

PROCESSING SECTION FOR A FLOOR-PROCESSING MACHINE, ADAPTER SYSTEM FOR A FLOOR-PROCESSING MACHINE, FLOOR-PROCESSING MACHINE AND TOOL THEREFOR

The invention relates to a processing section for an adaptor system of a floor-processing machine, an adapter system, a floor-processing machine as well as a tool to be used with an adapter system according to the invention and/or a floor-processing machine according to the invention.

Mostly, such types of floor-processing machines are constructed as floor-grinding machines and are usually employed for processing floor surfaces. With such types of floor-processing machines, for example concrete, asphalt, natural stone or other floor surfaces are grinded, polished or otherwise surface-processed. Further, floor-grinding machines are also used to recondition floor surfaces, for example to remove glue remnant, putty remnant etc.

Therefore, the floor-processing machine comprises a drive shaft on which a grinding tool is attached. Generally, the grinding tool comprises a carrier plate with a mostly flat processing side facing the floor surface to be processed, which is rotated by the drive shaft. For clarification, it shall be noted that the terms "axial" and "radial" used from here onwards refer to the longitudinal extension of the drive shaft or rather the rotation axis of the carrier plate or a comparable component. By movement of the floor-processing machine across the floor to be processed, the top layer of the floor is processed, in particular removed or rather grinded by the rotating grinding tool. As a matter of course, the grinding tool is worn out after a certain operating period, for example depending on the floor to be processed, and must be replaced in order to reach a satisfying processing result.

Regarding known floor-processing machines, the entire grinding tool is generally disassembled and replaced. This is extremely time-consuming on the one hand, since the grinding tool is usually secured with several screws to a respective mounting section of the drive shaft. On the other hand, the processing surface is permanently connected to the carrier plate such that the entire unit needs to be disposed or recycled respectively. None the less, this is not up to date for sustainability and environment protection reasons.

Furthermore, costs are increased hereby, in particular storage and logistics costs. For example, the carrier plates of the grinding tools comprise a diameter of 230 mm, 270 mm, 280 mm or 400 mm, such that a wholesale dealer is required to hold a plurality of such grinding tools in stock. The necessary storage space needs to be large, respectively. During the time of processing, several of such grinding tools need to be stocked at the construction site itself in order to not lengthen the idle times of the floor-processing machine further.

The aforementioned effects are increased by the fact that, depending on the type of floor to be processed or rather the progress of processing, different grinding tools need to be used. For example, for coarse processing, a grinding tool with coarse grit is required at first, wherein a finalizing polishing is executed with a finer grit of the grinding tool respectively.

Other solutions are also known from the state of the art, wherein individual processing sections are fixed on a carrier plate, as shown in DE 202 20 969 U1 for example. However, the processing surfaces or profiles are still permanently connected with a solid subcarrier, being screwed or soldered to the carrier plate. In case of an individual replacement of the processing sections, being not intended anyway, the complete subcarrier must be removed with great effort, if at all possible. Furthermore, in case of a screw connection, the entire surface of the subcarrier cannot be used as processing surface, since there at least must always be passageways for the screws.

It is therefore the object of the invention to minimize or eliminate the aforementioned disadvantages of floor-processing machines during floor processing and in particular to present a more sustainable system requiring significantly less effort.

The problem is solved by a processing section for an adapter system of a floor-processing machine, an adapter system for a floor-processing machine, a floor-processing machine and a tool for use.

The processing section for a floor-processing machine adapter system according to the invention comprises a base body with a processing side and a mounting side. The mounting side is arranged on the opposite side of the processing side of the base body. According to the invention, the mounting side comprises at least one first mounting element for detachably fastening the processing section to the adapter system, wherein the processing side is formed as a closed processing surface.

In other words, the processing section has two sides, wherein the processing section with the mounting side being mountable to an adapter system. Furthermore, the processing surface is constructed completely closed, hence without breakthroughs, receptacles or holes for locking means such as screws or the like. By that, the available processing surface is increased such that a longer overall period of use of the processing section can be achieved. Moreover, the processing section according to the invention merely consists of a base body with a mounting side and a processing side, such that only the individual processing section needs to be exchanged in case of a replacement. The adapter system, taking over the function of the carrier plate, remains firmly connected to the floor-processing machine and neither requires time-consuming disassembling nor does it need to be disposed.

Advantageously, the first mounting element comprises at least one torsionally stiff first connection means for form-fittedly and/or friction-fittedly fastening the processing section. In particular, it has been proven to be preferable, if the first connection means is a hook-and-loop means. Accordingly, the complementary hook-and-loop means is arranged at the adapter system. Thus, the processing section can be fixed to the adapter system with less effort, by the processing section basically being placed onto or removed from the adapter system in axial direction, without any additional mounting work being necessary (such as tightening or loosening screws). Moreover, the processing surface may extend across the entire processing side, facing the floor during operation, since no breakthroughs or the like are needed for receiving screws or the like. Rather, it is not required that the first connection means in form of a hook-and-loop means is reachable by a tool or the like for mounting.

Preferably, the base body is formed disk-shaped, in particular round disk-shaped. In this context, it is advantageous if the base body comprises a diameter of 60 mm to 150 mm, preferably of 80 to 130 mm and particularly of 100 mm. This results in a sufficiently large processing surface and at the same time reduced space requirements. Overall, this results in particularly good manageability of the individual processing section.

Preferably, the processing surface comprises metal-bonded and/or diamond-bonded and/or plastic-bonded grinding profiles. Therefore, depending on the type of floor surface to be processed, a suitable processing section can be selected for an optimized processing result beside a reduction of process dust.

The problem is further solved by an adapter system for a floor-processing machine. The adapter system is mountable to a floor-processing machine. According to the invention, the adapter system according to the invention distinguishes from adapter systems known in the state of the art by comprising a receiving side with at least one receptacle, wherein the receptacle comprises at least one second mounting element for detachably fastening a processing section in the receptacle. Thereby, the above mentioned advantages regarding the processing section according to the invention can be achieved that on one hand, no great effort is necessary in order to replace a processing section. On the other hand, manageability is improved significantly, since it is not necessary to exchange the entire adapter system in terms of a carrier plate with an attached processing surface. Rather, the adapter system remains on the floor-processing machine and merely the much smaller in dimension processing section is replaced when needed.

Preferably, the second mounting element comprises at least one torsionally stiff second connection means for friction-fittedly and/or form-fittedly fastening the processing section. In particular, it was proven beneficial if the second connection means was a hook-and-loop means. Accordingly, the complementary hook-and-loop means is arranged at the processing section. Therefore, the processing section can be fixed to the adapter system with less effort with the processing section basically being placed onto or removed from the adapter system in axial direction, without the necessity of additional mounting work as it would be the case for example during tightening or loosening of a screw.

Preferably, the second mounting element comprises a spring unit. In this way, it can be ensured that the at least one processing section received in the at least one receptacle is able to adapt to uneven sections of the floor because of the floating support. Furthermore, this also prevents increased wear of the processing surface because of a too high contact pressure. As a matter of course, the spring unit may also be implemented as a damper unit or in combination with such, without posing a disadvantage for the processing result.

Hereby it is advantageous, if the spring assembly is a composite component. In the sense of the invention, a composite component is to be understood as a component comprising a metal part and a plastic part which is inextricably connected to the metal part. In particular, the plastic part is a foamed plastic. The foamed plastic or rather its material properties are selected in such a way that the desired spring property of the processing section is achieved. Consequently, a sandwich-like structure is achieved, which consists at least of the plastic part, metal part and second connection means, preferably in the described order. It is also conceivable that the spring unit or rather a further spring unit is attached to the processing section, if this was necessary for the particular application. Likely, it is conceivable that the plastic part is arranged between two metal parts in order to achieve a particularly robust attachment.

Preferably, the adapter system is disk-shaped, in particular round disk-shaped, wherein the adapter system comprises several receptacles arranged on the receiving side, preferably circularly, for receiving processing sections. It was shown to be especially preferable if the receptacles take up from 25% to 50%, in particular 30% to 45%, and exceptionally preferable from 35% to 40% of the receptacle surface, such that a particularly superior processing result is achieved, because the processing surfaces of the processing sections, being arranged in the receptacles, take up an equal surface fraction. In this context, it is advantageous if the receptacles are basically arranged along the circumference of the adapter system. It is further preferable if the receptacles are only arranged along the circumference, meaning arranged outside in radial direction in relation to the rotational axis of the adapter system. It has been shown that the processing sections arranged in the receptacles may have to bear an unbalanced load if the receptacles are arranged relatively close to the rotational axis of the adapter system. On the one hand, this may result in uneven wear of the processing sections. On the other hand, it may also result in a divergent processing result, which possibly is getting worse by the uneven wear.

It is advantageous, if the at least one receptacle comprises at least one boundary wall, wherein the boundary wall extends from the receiving side of the adapter system in axial direction. In particular, the boundary wall is constructed such that a processing section, arranged in the receptacle, is essentially arranged in the receptacle or rather inside in an axial direction in relation to the boundary wall, at least during operation of the floor-processing machine, wherein the processing surface of the processing section protrudes in axial direction from the boundary wall. This prevents the processing section from slipping out—for example due to centrifugal forces. As a matter of course, the boundary wall is configured such that it does not contact the floor surface to be processed even during impact of the spring unit by an axial inward acting force, while the floor-processing machine is in operation. It is also conceivable that during operation the processing section relocates the axially inwardly acting force toward the spring force of the spring unit in such a way that the processing section is only then prevented by the boundary wall from slipping out.

Hereto it is expedient, if the boundary wall comprises at least one tool breakthrough for receiving a tool. This way, the tool may be inserted in order to quickly and largely effortlessly remove a processing section received in the receptacle.

During operation, the adapter system comprises at least one processing section according to the invention, wherein the at least one processing section is mounted in the at least one receptacle. It was shown that a particular good processing result is achieved when preferably several processing sections are attached in several receptacles, in particular when six receptacles are provided along the circumference of the adapter system in a circular arrangement.

Further, the problem is solved by a floor-processing machine, which comprises an adapter system in accordance with the invention. Particularly, the floor-processing machine is a floor-grinding machine.

Furthermore, according to the invention, a tool is proposed to be used with an adapter system and/or floor-processing machine according to the invention. The tool comprises a nose and a lever shaft, wherein the nose is insertable between the receiving side of the adapter system and the mounting side of the processing section in such a way that the processing section is removable from the receptacle by moving the lever shaft relative to the adapter system. In this way, a processing section attached in the receptacle can be quickly removed from the receptacle with little effort by moving the lever shaft, if for example a wear and tear induced replacement is scheduled.

Figure 1B:
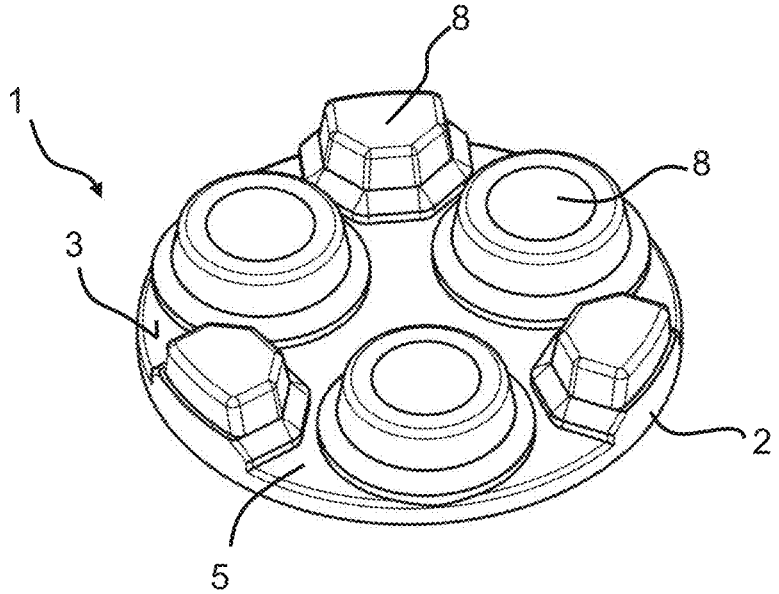
Figure 2:
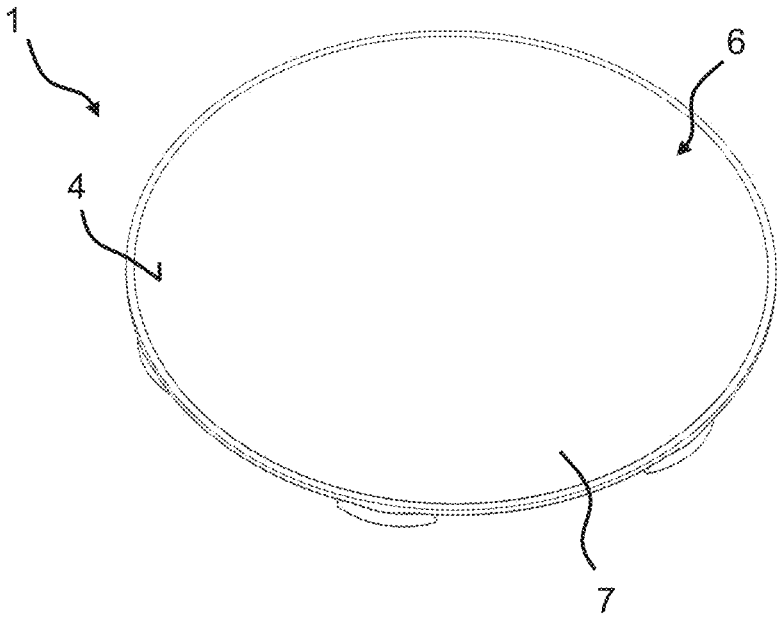
Figure 3:
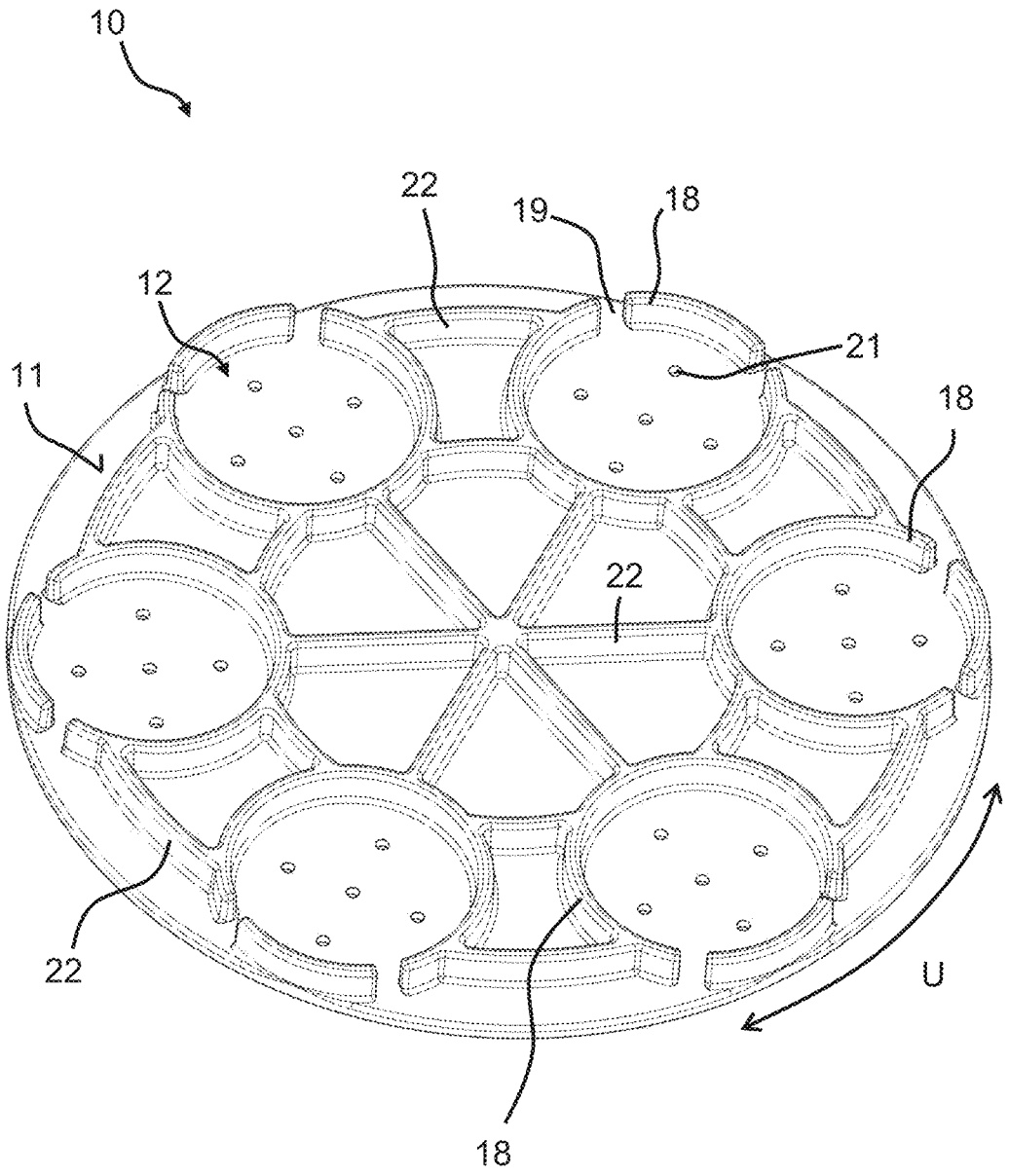
Figure 4:
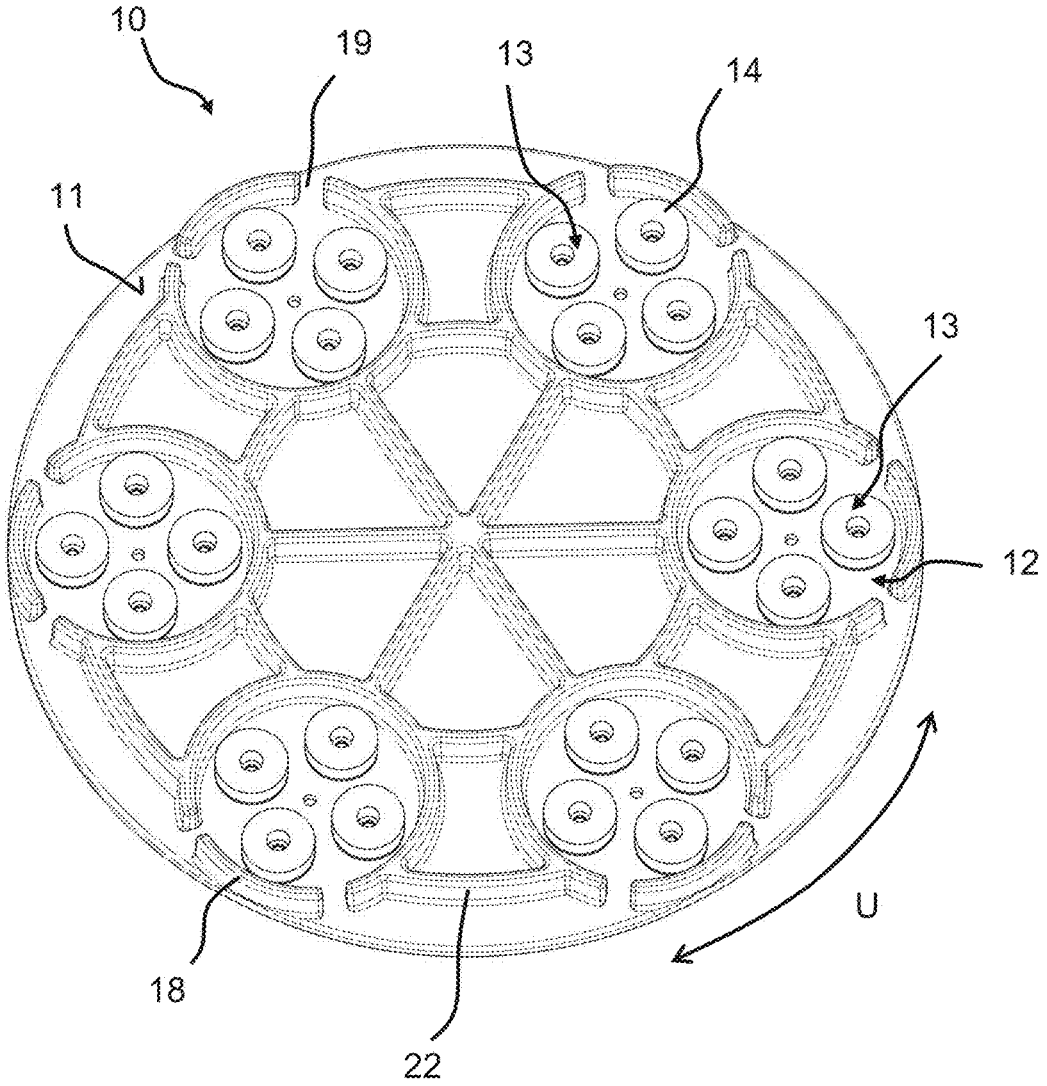
Figure 5:
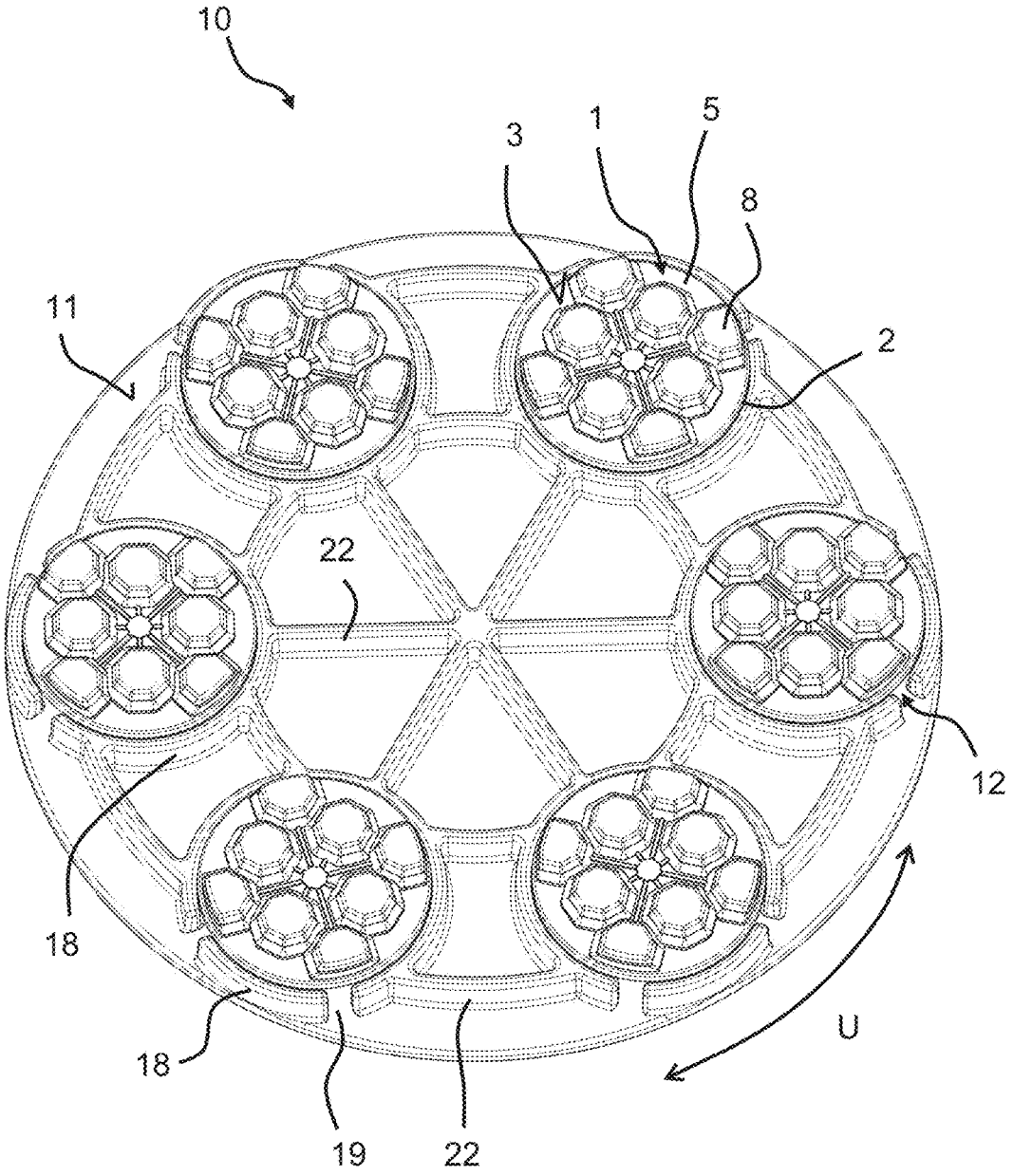
Figure 6:
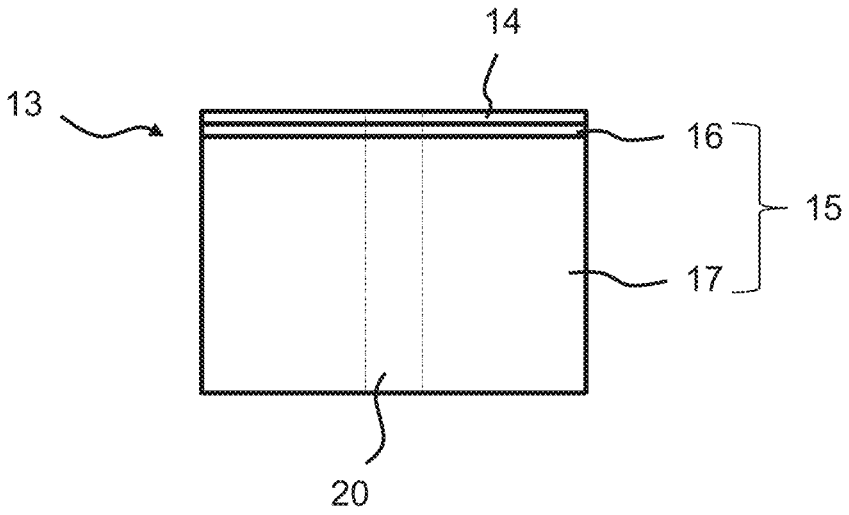
Figure 7:
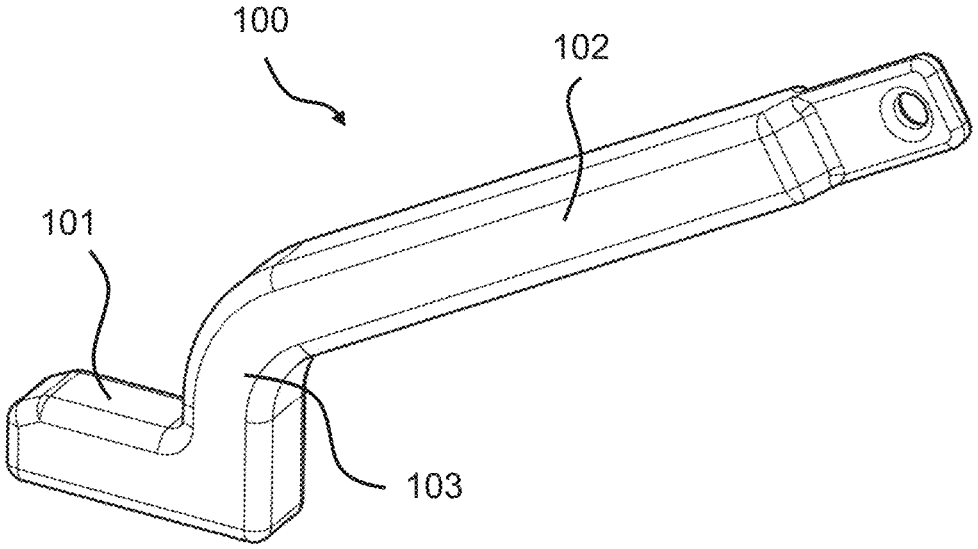
Figure 8:
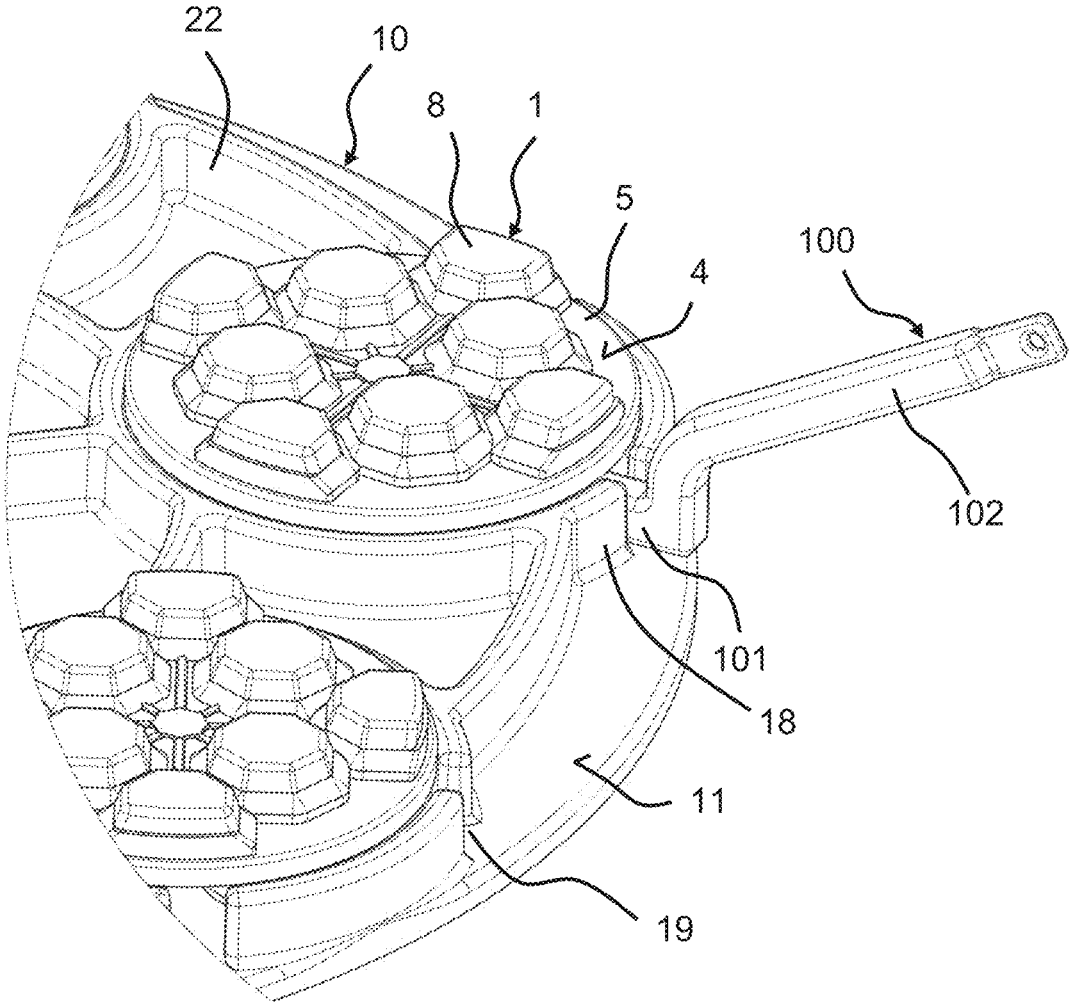
Figure 9:
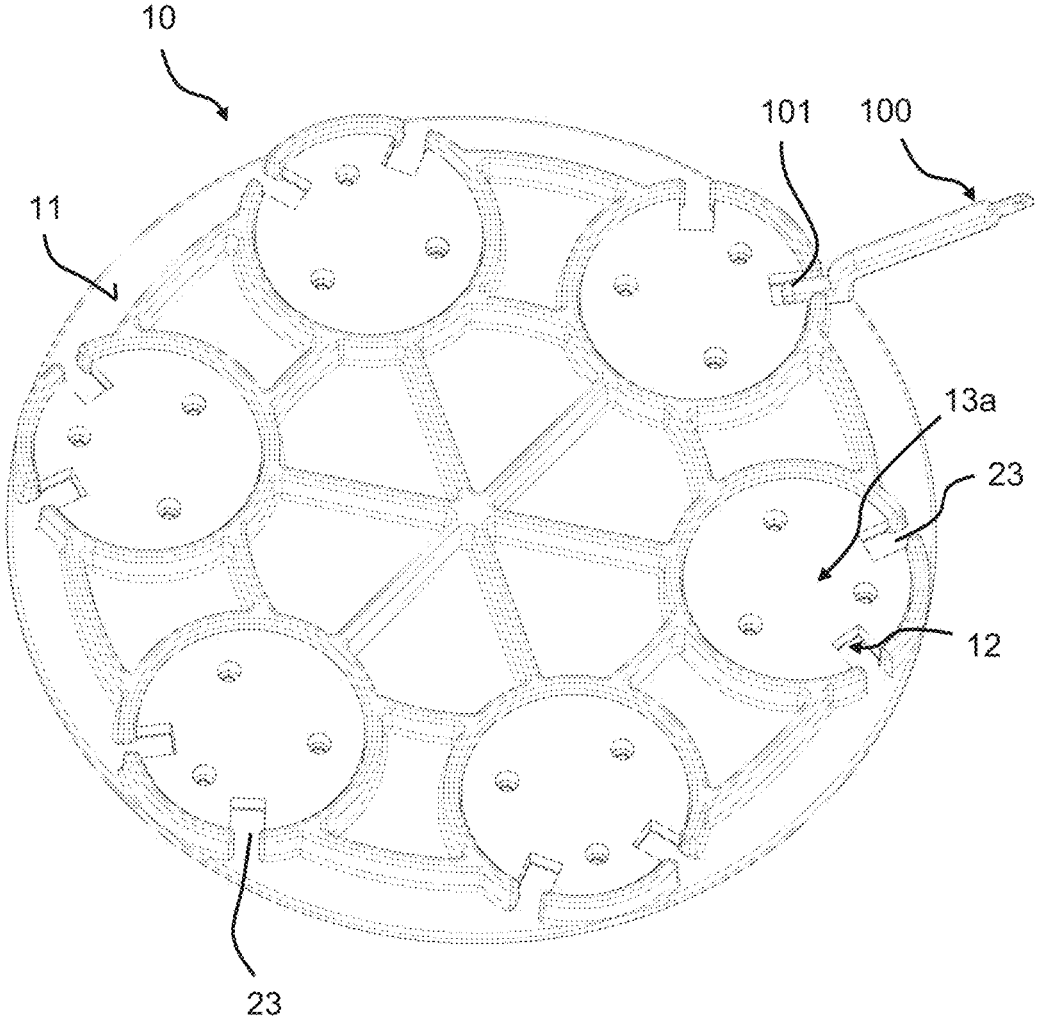
Figure 10:
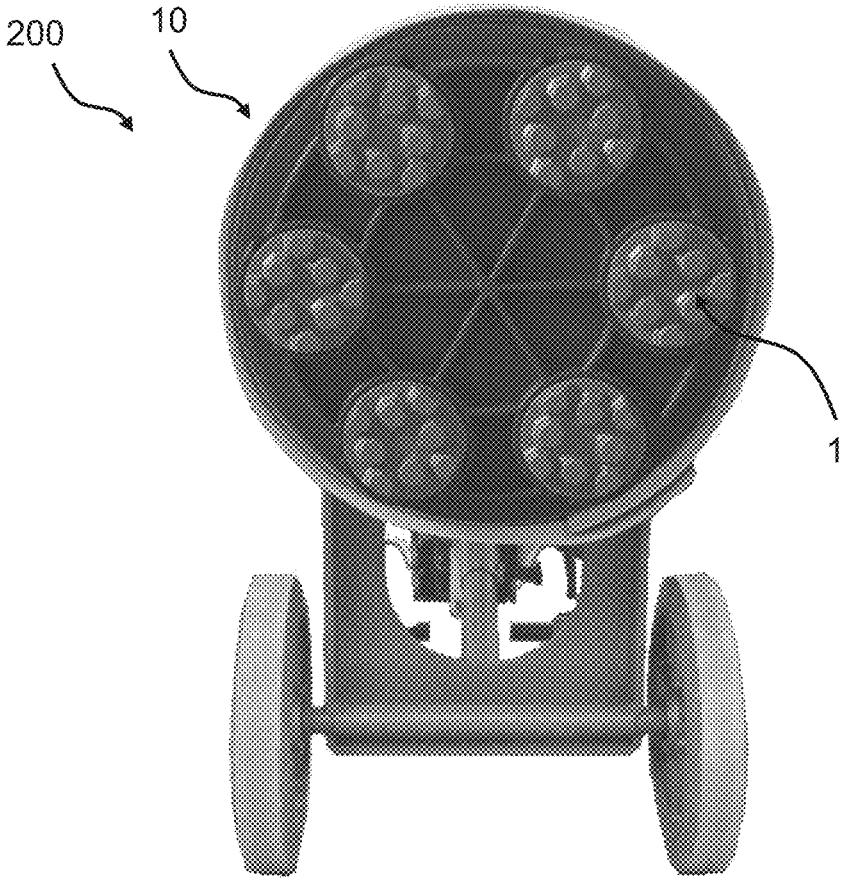

In the following, the invention will be explained in more detail on the basis of selected embodiments shown in the various drawings. Hereto, it is shown schematically:

FIG. 1A a perspective view of a processing section according to a first embodiment;

FIG. 1B a perspective view of a processing section according to a second embodiment;

FIG. 2 a perspective view of a processing section;

FIG. 3 a perspective view of an adapter system without second mounting elements and without received processing sections;

FIG. 4 the adaptor system of FIG. 3 with second mounting elements;

FIG. 5 the adapter system of FIG. 4 with received processing sections;

FIG. 6 a side view of a second mounting element;

FIG. 7 a perspective view of a tool;

FIG. 8 a perspective view of a tool of FIG. 7 for removing a processing section from an adapter system;

FIG. 9 a second embodiment of an adaptor system according to the invention with only one second mounting element; and FIG. 10 a floor-processing machine with an adapter system with received processing sections.

FIG. 1A discloses a processing section 1, comprising a round disc-shaped base 2 with a processing side 3 and a mounting side 4 (cf. FIG. 2). As apparent from FIG. 1A and FIG. 2, the processing side 3 is arranged on the one side of the base body 2, and the mounting side 4 is arranged on the other side of the base body 2, opposed to the processing side 3. The mounting side 4 comprises a first mounting element 6. The mounting element 6 comprises a torsionally stiff first connection means 7, which is basically also constructed round disk-shaped and largely covers the mounting side 4, as shown in FIG. 2. In this embodiment, the first connection means 7 is a hook-and-loop means, which provides a torsionally stiff fastening.

As shown in FIG. 1A, the processing side 3 is constructed as a closed processing surface 5. The processing surface 5 comprises grinding profiles 8, which extend from the processing side 3 in radial direction. In the embodiment shown in FIG. 1A, four centrally arranged octagonal grinding profiles 8 are provided, as well as four further polygonal grinding profiles 8 arranged at the circumference of the processing section 1.

Another embodiment for a processing section 1 according to the invention is shown in FIG. 1B. This merely distinguishes from the embodiment shown in FIG. 1A in shape and arrangement of the grinding profiles 8. As shown in FIG. 1B, the grinding profiles 8 may also be round-cylindrical. The grinding profiles 8 may be formed as metal-bonded, diamond-bonded and/or plastic-bonded grinding profiles 8. Depending on which kind of floor processing is to be done, suited processing sections 1 will be selected and mounted onto an adapter system 10, as described in more detail as follows.

In FIGS. 3 to 5 an adapter system 10 according to the invention is shown, wherein FIG. 3 shows the adapter system without second mounting elements 13, FIG. 4 shows the adapter system 10 with second mounting elements 13 mounted on the same, and FIG. 5 shows the adapter system 10 with processing sections 1 mounted on the same. As can be seen in the figures, the adapter system 10 is round disk-shaped.

The adapter system 10 has a receiving side 11 with several receptacles 12 for receiving processing sections 1 (cf. FIG. 5). In the shown embodiment, the adapter system 10 comprises six receptacles 12 that are circularly arranged in regular intervals along the circumference U of the adapter system 10. As shown in FIG. 4, each one receptacle 12 comprises four second mounting elements 13. The mounting elements 13 are all equally configured, constructed as round cylinders and evenly arranged inside the receptacle 12.

FIG. 6 shows cut free view of a second mounting element 13. The mounting element 13 comprises a torsionally stiff second connection means 14. The second connection means 14 extends substantially parallel to the receiving side 11 of the adapter system 10. In this embodiment, the second connection means 14 is a hook-and-loop means, which is complementary to the first connection means 6 being a hook-and-loop means as well. Other torsionally stiff connection means 6 and 14 may also be possible, for example in shape of a bayonet lock or the like.

Furthermore, the second mounting element 13 comprises a spring unit 15. The spring unit 15 is a composite component, which comprises a metal part 16 and a plastic part 17. The metal part 16 is constructed round disk-shaped and arranged between the second connector 14 and the plastic part 17. In this embodiment, the plastic part 17 is a plastic foam component with certain elastic properties that define the suspension or damping properties of the spring unit 15, respectively.

Moreover, the second mounting element 13 comprises a central through hole 20 for receiving a locking device (not shown in further detail). This way, the second mounting element 13 may be fixed at the receptacle 12 of the adapter system 10 via a corresponding locking means receptacle 21.

The receptacles 12 of the adapter system 10 further comprise boundary walls 18. The boundary walls 18 extend from the receiving side 11 of the adapter system 10 in axial direction and form a substantially circular boundary of the receptacle 12. Further, the boundary walls 18 comprise two breakthroughs 19 per each receptacle 12. The breakthroughs 19 face radially outward and are arranged along the circumference U of the adapter system 10. The breakthroughs 19 serve for the insertion of a tool 100, as described in more detail in the following.

The boundary walls 18 of the individual receptacles 12 are connected to each other with stiffening fins 22, which also extend from the receiving side 11 of the adapter system 10 in axial direction, and stabilize the adapter system 10 in itself. As for example shown in FIG. 3, the stiffening fins 22 are arranged radially star-shaped towards the inside. Further, in between the individual receptacles 12, in each case two arcuate shaped stiffening fins 22 running in the direction of the circumference U of the adapter system 10 are arranged.

To mount a processing section 1 to the adapter system 10, the processing sections 1 are inserted into the respective receptacle 12 in axial direction until the first connection means 7 of the processing section 1 contacts the second connector means 14 of the receptacle 12 of the adapter system 10. The processing section 1 is then releaseably mounted in the receptacle 12 by slight pressure in axial direction. Since the first connection means 6 covers almost the entire mounting side 4 of the processing section 1 (cf. FIG. 2), the orientation of the processing section 1 in relation to the receptacle 12 is irrelevant.

To remove a processing section 1 from a receptacle 12, the tool 100 shown in FIG. 7 is to be used. The tool 100 comprises a nose 101 and a lever shaft 102. The nose 101 is connected with the lever shaft 102 via a curved transition part 103. Furthermore, the nose 101 is constructed to be inserted into the receptacle 12 through a breakthrough 19 of a boundary wall 18 of a receptacle 12, as can be seen in FIG.

8. In this state, the nose 101 is arranged between the receiving side 11 of the adapter system 10 and the mounting side 4 of the processing section 1 in axial direction. The tool 100 tilts in the area of the rear edge of the nose 101 by moving the lever shaft 103 relative to the adapter system 10, so that the nose 101 is rearranged in the direction of the mounting side 4 of the processing section 1. The nose 101 contacts the mounting side 4 of the processing section 1 and pushes the processing section 1 out of the receptacle 12 in axial direction. Hereby, the connection between the first mounting element 6 of the processing section 1 and the four second mounting elements 13 of the receptacle 12 is released and the processing section 1 may be lifted off the adapter system 10.

FIG. 9 discloses a second embodiment of the adapter system 10 according to the invention. The adapter system 10 shown in FIG. 9 distinguishes from the adapter system described before in that the receptacle 12 only comprises one second mounting element 13*a*. The second mounting element 13*a* shown in this figure is essentially equally constructed as the second mounting element 13 disclosed in FIG. 6, hence, comprising a spring unit 15 in form of a composite component. Since the second mounting element 13*a* almost completely occupies the receptacle, the second mounting element 13 has two notches 23 for receiving the nose 101 of the tool 100. The tool 100 is exemplarily shown in FIG. 9, wherein the nose 101 is received within one of the notches 23. It may be well observed that the nose 101 reaches through the breakthrough 19 and is arranged between the receiving side 11 of the adapter system and the processing side 4 of the processing section 1 (not shown).

FIG. 10 shows a floor-processing machine 200. The floor-processing machine 200 is a floor-grinding machine and comprises an adaptor system 10 according to the invention with 6 attached processing sections 1 according to the invention. During operation of the floor-processing machine 200, the grinding profiles 8 of the processing surface 5 of the processing section 1 lie atop the floor surface to be processed. The drive shaft (not shown) of the floor-processing machine 200 puts the adapter system 10 with the torsionally stiff attached processing sections 1 in rotation, such that the floor surface is processed, in particular is grinded layer-wise by the grinding profiles 8. Due to the floating mount of the processing sections 1 created by the spring units 15, an optimum in processing result is achieved.

REFERENCES

1 processing section
2 base body
3 processing side
4 mounting side
5 processing surface
6 first mounting element
7 first connection means
8 grinding profile
10 adapter system
11 receiving side
12 receptacle
13 second mounting element
13*a* second mounting element
14 second connection means
15 spring unit
16 metal part
17 plastic part
18 boundary wall
19 breakthrough
20 through hole
21 locking device receptacle
22 stiffening fin
23 notch
100 tool
101 nose
102 lever shaft
103 transition joint
200 floor-processing machine
U circumference

The invention claimed is:

1. An adapter system for a floor-processing machine, the adapter system being mountable to the floor-processing machine, wherein the adapter system comprises a receiving side with at least one receptacle, wherein the receptacle comprises at least one mounting element, wherein the mounting element is arranged inside the receptacle and comprises a fastener for friction-fittedly and/or form-fittedly fastening the processing section in the receptacle and a composite spring comprising a metal part and a plastic part, wherein the metal part is arranged between the fastener and the plastic part forming a sandwich-like structure.

2. The adapter system according to claim 1, wherein the adapter system is formed disk-shaped, in particular round disk-shaped, wherein the adapter system comprises several receptacles arranged on the receiving side for receiving respective processing sections.

3. The adapter system according to claim 2, wherein the receptacles are arranged along a circumference of the adapter system.

4. The adapter system according to claim 1, wherein the at least one receptacle comprises at least one boundary wall, wherein the boundary wall extends from the receiving side of the adapter system in an axial direction.

5. The adapter system according to claim 4, wherein the boundary wall comprises at least one tool breakthrough for receiving a tool.

6. The adapter system according to claim 1, wherein the fastener is a first fastener, and the at least one processing section comprises a base body with a processing side and a mounting side, wherein the mounting side is arranged on an opposite side of the base body from the processing side, wherein the mounting side comprises at least one second fastener for detachably fastening the processing section to the first fastener of the adapter system, and wherein the processing side is formed as a closed processing surface.

7. The adapter system according to claim 6, wherein the first fastener comprises one of hook or loop fabric, and the second fastener comprises the other of loop or hook fabric.

8. The adapter system according to claim 1, wherein the mounting element defines a central through hole for locking the mounting element within the receptacle of the adapter system.

9. The adapter system according to claim 1, wherein the fastener comprises one of hook or loop fabric.

10. A floor-grinding machine with an adapter system wherein the adapter system being mountable to the floor-processing machine, wherein the adapter system comprises a receiving side with at least one receptacle, wherein the receptacle comprises at least one mountinq element, wherein the mountinq element is arranged inside the receptacle and comprises a fastener for friction-fittedly and/or form-fittedly fastening the processing section in the receptacle and a composite spring comprising a metal part and a plastic part, wherein the metal part is arranged between the fastener and the plastic part forming a sandwich-like structure;

wherein the mountinq element defines a central through hole for locking the mounting element within the receptacle of the adapter system.

* * * * *